US009395689B2

(12) United States Patent
Mae et al.

(10) Patent No.: US 9,395,689 B2
(45) Date of Patent: Jul. 19, 2016

(54) IMAGE FORMING APPARATUS

(71) Applicants: Hideo Mae, Kitanagoya (JP); Takayuki Ito, Nagoya (JP)

(72) Inventors: Hideo Mae, Kitanagoya (JP); Takayuki Ito, Nagoya (JP)

(73) Assignee: KONICA MINOLTA BUSINESS TECHNOLOGIES, INC., Chiyoda-Ku, Tokyo (JP)

( * ) Notice: Subject to any disclaimer, the term of this patent is extended or adjusted under 35 U.S.C. 154(b) by 3 days.

(21) Appl. No.: 13/766,823

(22) Filed: Feb. 14, 2013

(65) Prior Publication Data

US 2013/0223870 A1 Aug. 29, 2013

(30) Foreign Application Priority Data

Feb. 23, 2012 (JP) ..... 2012-036936

(51) Int. Cl.
*G03G 15/00* (2006.01)
*G03G 21/20* (2006.01)

(52) U.S. Cl.
CPC ..... *G03G 21/20* (2013.01)

(58) Field of Classification Search
USPC ..... 399/91; 381/73.1
See application file for complete search history.

(56) References Cited

U.S. PATENT DOCUMENTS

| | | | |
|---|---|---|---|
| 5,784,670 | A | 7/1998 | Sasahara et al. |
| 5,930,557 | A | 7/1999 | Sasahara et al. |
| 2006/0239734 | A1 | 10/2006 | Ohtsuki |
| 2008/0124159 | A1 | 5/2008 | Oyama |
| 2010/0085608 | A1 | 4/2010 | Enomoto |
| 2011/0038645 | A1 | 2/2011 | Oh et al. |

FOREIGN PATENT DOCUMENTS

| | | | |
|---|---|---|---|
| CN | 1851563 | A | 10/2006 |
| CN | 101271300 | A | 9/2008 |
| JP | 9-193506 | A | 7/1997 |
| JP | 2012-025533 | A | 2/2012 |

OTHER PUBLICATIONS

Machine translation of Ishikawa, JP 2012-025533.*

(Continued)

*Primary Examiner* — David Gray
*Assistant Examiner* — Sevan A Aydin
(74) *Attorney, Agent, or Firm* — Buchanan Ingersoll & Rooney PC

(57) ABSTRACT

An image forming apparatus, having: a supply unit that forwards a sheet material; a rotor that feeds the sheet material; a memory unit that has stored therein a masking sound for noise; a derivation unit that derives a current position of the sheet material being fed; a determination unit that determines, on the basis of the current position derived by the derivation unit, whether or not the sheet material being fed has reached a second specified location at a predetermined distance upstream from the first specified location; a decision unit that decides output timing and/or output duration for the masking sound in the memory unit upon an affirmative determination by the determination unit; and a sound output unit that outputs the masking sound in the memory unit in accordance with the output timing and/or the output duration.

8 Claims, 11 Drawing Sheets

(56) References Cited

OTHER PUBLICATIONS

Office Action (Notification of Reasons for Refusal) issued on Jan. 28, 2014, by the Japan Patent Office in corresponding Japanese Patent Application No. 2012-036936, and an English Translation of the Office Action. (5 pages).

First Office Action issued Nov. 21, 2014, in corresponding Chinese Patent Application No. 201310056630.6, with English translation (14 pages).

* cited by examiner

IMAGE FORMING APPARATUS

This application is based on Japanese Patent Application No. 2012-036936 filed on Feb. 23, 2012, the content of which is incorporated herein by reference.

BACKGROUND OF THE INVENTION

1. Field of the Invention

The present invention relates to an image forming apparatus that masks noise generated therein.

2. Description of Related Art

Conventionally, to deal with noise generated by an image forming apparatus, a so-called "noise reduction technology" for reducing noise is employed. Noise reduction lowers the sound pressure level of noise, but does not completely solve problems of nearby workers perceiving "harshness" and "discomfort" caused by noise.

Aside from the Noise reduction technology, there has also been proposed a sound masking technology as a technology to lower noise (i.e., a technology to a level being less perceptible to nearby workers). Sound masking is a method taking advantage of a phenomenon (i.e., sound masking effect) in which perception of a sound at a certain level makes other sounds barely audible, and this method is mainly classified into frequency masking and temporal masking. More specifically, noise is superimposed with a sound (i.e., masker or masking sound) mainly similar in frequency band to the noise, so that the noise is made barely audible, thereby reducing harshness and discomfort.

As a conventional image forming apparatus applying the sound masking technology, there is a noise masking device described in Japanese Patent Laid-Open Publication No. 9-193506. This noise masking device includes a sound generator for generating masking sounds to mask operation sounds generated by various drive mechanisms, and a masking sound control unit for controlling the sound generator to generate a masking sound within a frequency range including the main component frequency of the operation sound. The masking sound control unit allows the masking sound to be generated within a frequency range between the lower and upper limits of a critical frequency band for the main component frequency of the operation sound.

In addition to the operation sounds of the drive mechanisms, the image forming apparatus generates various types of noise. Examples of such noise include: (1) collision noise made by a sheet material (e.g., paper) to be fed hitting a nip created by a rotor for feeding sheet materials; and (2) frictional noise made by the sheet material passing through a curved portion of a feeding path in the image forming apparatus.

The noise as specified in (1) and (2) above is suddenly generated at specific portions such as the nip and the curved portion of the feeding path. However, there are variations in precision of feeding sheet materials. For example, in the case where sheet materials are individually measured for the time of noise generation after the sheet materials leave a tray, variations in the time of noise generation among the sheet materials might be in the order of 100 milliseconds [ms], for example, due to delays of supply from the tray.

Furthermore, the rotor deteriorates over time, so that the generation time for the noises specified in (1) and (2) above can change in accordance with the duration of use of the rotor in addition to variations in precision of feeding sheet materials.

As can be appreciated from the foregoing, since the generation time for sudden noise can change, outputting a masking sound for such noise in accordance with uniform timing might not be satisfactorily effective.

SUMMARY OF THE INVENTION

An image forming apparatus according to an embodiment of the present invention includes: a supply unit that forwards a sheet material on a tray to a feeding path; a rotor that feeds the sheet material in the feeding path; a memory unit that has stored therein a masking sound for noise generated at a first specified location in the feeding path during the feeding of the sheet material; a derivation unit that derives a current position of the sheet material being fed in the feeding path; a determination unit that determines, on the basis of the current position derived by the derivation unit, whether or not the sheet material being fed has reached a second specified location at a predetermined distance upstream from the first specified location; a decision unit that decides output timing and/or output duration for the masking sound in the memory unit upon an affirmative determination by the determination unit; and a sound output unit that outputs the masking sound in the memory unit in accordance with the output timing and/or the output duration decided by the decision unit.

DETAILED DESCRIPTION OF THE PREFERRED EMBODIMENTS

Embodiment

Figure 1:
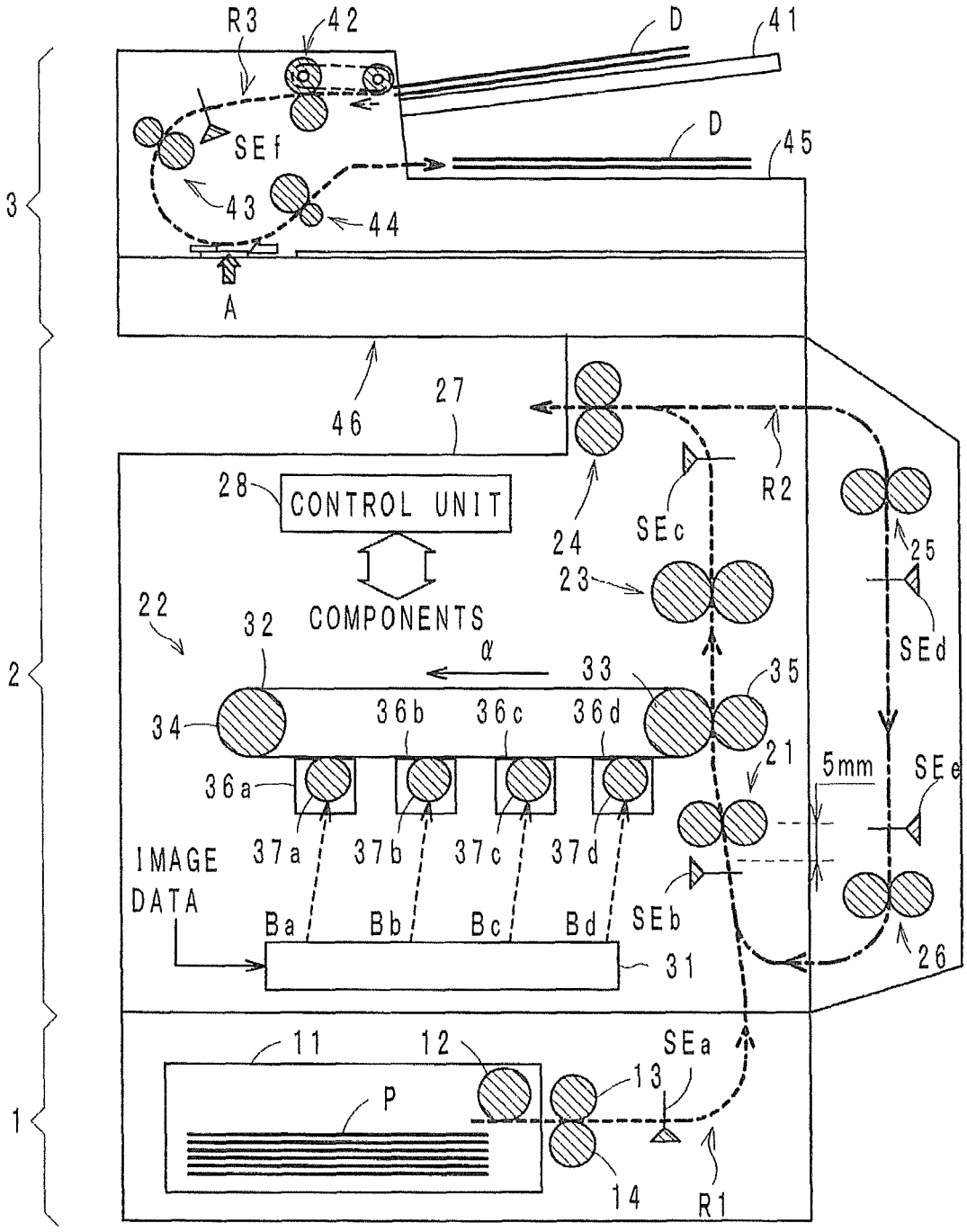
FIG. 1 is a cross section schematically illustrating the configuration of an image forming apparatus according to an embodiment of the present invention.

Hereinafter, an image forming apparatus according to an embodiment of the present invention will be described. For convenience of explanation, the width and height directions of the image forming apparatus correspond to the width and length directions of the sheet of FIG. 1. Moreover, some components of the image forming apparatus have affixes a, b, c, and d to the right of their reference numerals. The affixes a, b, c, and d denote yellow (Y), magenta (M), cyan (C), and black (K). For example, photoreceptor drum 37*a* denotes the photoreceptor drum 37 for yellow.

Basic Configuration of Image Forming Apparatus

In FIG. 1, the image forming apparatus is a full-color electrophotographic multifunction peripheral or suchlike in which toner images for the colors Y, M, C, and K are superimposed on the basis of input image data in a so-called tandem system, thereby generating a full-color composite toner image. The image forming apparatus prints the generated composite toner image onto a sheet material P (e.g., paper). To perform such print processing, the image forming apparatus includes a supply unit 1 and a main unit 2 provided thereon, as shown in FIG. 1.

In the supply unit 1, a pickup roller 12 takes up sheet materials P placed on a supply tray 11. A supply roller 13 and a separation roller 14 forward the sheet materials P taken up by the pickup roller 12 one by one to a feeding path R1 (see a dotted line).

In the main unit 2, a resist nip is created by a pair of rollers, which will be referred to below as a resist roller pair 21. The sheet material P contacts the resist nip when it is forwarded from the supply unit 1 and fed through the feeding path R1. The resist roller pair 21 has the function of adjusting the timing of feeding the sheet material P under control of a control unit 28, so as to be in synchronization with image formation, and is driven to rotate and stop the rotating under control of a control unit 28. The resist roller pair 21 forwards the sheet material P temporarily stopped by contact, to the downstream of the feeding path R1 in accordance with the adjusted timing.

Furthermore, in the main unit 2, an imaging unit 22 is provided immediately downstream from the resist roller pair 21 in the feeding path R1, and includes an optical scanning device 31, an intermediate transfer belt 32, a drive roller 33, a driven roller 34, a secondary transfer roller 35, and image generating units 36*a* to 36*d* for the colors Y, M, C, and K. In addition, the image generating units 36*a* to 36*d* include rotatable photoreceptor drums 37*a* to 37*d*.

The optical scanning device 31 receives the input image data. The optical scanning device 31 generates optical beams Ba to Bd for Y, M, C, and K on the basis of the input image data, and scans the beams on the outer circumferential surfaces of the photoreceptor drums 37*a* to 37*d* being charged. As a result, an electrostatic latent image is generated on each of the outer circumferential surfaces. Thereafter, for each color, the electrostatic latent image is developed by an unillustrated developing device for that color, thereby generating a toner image of the color.

The intermediate transfer belt 32 in an endless form is stretched between the drive roller 33 and the driven roller 34, and is rotated in the direction of arrow α. In a predetermined area of the intermediate transfer belt 32, the toner images supported by the photoreceptor drums 37*a* to 37*d* are sequentially transferred (primary transfer), so that the toner images of the colors overlap with one another, thereby forming a full-color composite toner image. The composite toner image is fed to the secondary transfer roller 35 by means of drive by the intermediate transfer belt 32.

The secondary transfer roller 35 is in contact with the intermediate transfer belt 32, so that a secondary transfer nip is created therebetween. The sheet material P from the resist roller pair 21 is introduced to the secondary transfer nip. Since a transfer voltage is applied to the secondary transfer roller 35, the composite toner image on the intermediate transfer belt 32 is subjected to secondary transfer onto the sheet material P passing through the secondary transfer nip. The secondary transfer roller 35 and the intermediate transfer belt 32 forwards the sheet material P subjected to secondary transfer, toward the downstream of the feeding path R1.

A fuser 23 includes a heating roller and a pressure roller. The fuser 23 fuses and fixes the composite toner image onto the sheet material P from the secondary transfer nip by passing the sheet material P through a fusing nip created by the rollers. Thereafter, the fuser 23 forwards the sheet material P to a reversing/ejecting roller pair 24 provided in the downstream of the feeding path R1.

At the time of double-side printing on the sheet material P, when the sheet material P with a first side subjected to fusing processing is introduced from the fuser 23, the reversing/ejecting roller pair 24 reverses the direction of the sheet material P through a switchback, thereby forwarding the sheet material P to a reverse path R2 (see a long dashed short dashed line) for printing on a second side. The sheet material P is fed toward the resist roller pair 21 by double-side feeding roller pairs 25 and 26 disposed in the reverse path R2. Thereafter, the sheet material P contacts the resist nip in a turned-over state. Then, the second side is subjected to secondary transfer and fusing processing in the same manner as described above.

When the sheet material P with the second side subjected to fusing processing is introduced, the reversing/ejecting roller pair 24 ejects the sheet material P to an output tray 27. In the case of single-side printing, the sheet material P with the first side subjected to fusing processing is ejected through the reversing/ejecting roller pair 24 to the output tray 27 without its direction being reversed through a switchback.

The resist roller pair 21, a set of the intermediate transfer belt 32 and the secondary transfer roller 35, a set of the heating roller and the pressure roller included in the fuser 23, the reversing/ejecting roller pair 24, and the double-side feeding roller pairs 25 and 26 are typical examples of rotors.

The control unit 28 includes a CPU, main memory, and so on, and controls components of the image forming apparatus and an ADF 3 to be described later.

Sheet Material Position Detecting Unit

Furthermore, the image forming apparatus is provided with position detecting units at some points in the feeding path R1 and the reverse path R2 to, for example, manage the position of the sheet material P being fed. FIG. 1 shows examples of the position detecting units: a feed sensor SEa provided immediately downstream of the supply roller 13; a resist sensor SEb provided immediately upstream of the resist roller pair 21; and an ejection sensor SEc provided immediately downstream of the fuser 23. Moreover, the position detecting units provided in the reverse path R2 are a double-side feed sensor SEd provided immediately downstream of the double-side feeding roller pair 25 and a double-side feed sensor SEe provided immediately upstream of the double-side feeding roller pair 26. The sensors SEa to SEe are, for example, reflective photosensors, which emit light from their locations toward the feeding path R1 or the reverse path R2, and, upon reception of light reflected by the sheet material P being fed, output to the control unit 28 a detection signal indicating the current position of the sheet material P (more specifically, the current position of the leading edge of the sheet material P).

Regarding Noise Inside Image Forming Apparatus

Examples of the noise generated by the image forming apparatus are listed in the following (A) to (F):

(A) Drive noise from drive mechanisms (such as motors) for the rotors, etc.;

(B) Frictional noise caused by the sheet material P passing through a first curved portion of the feeding path R1 (from the supply roller 13 to the resist sensor SEb);

(C) Collision noise caused by the sheet material P contacting the resist nip;

(D) Collision noise caused by the sheet material P contacting the secondary transfer nip;

(E) Collision noise caused by the sheet material P contacting the fusing nip; and (F) Frictional noise caused by the sheet material P passing through a second curved portion of the feeding path R1 (e.g., from the fuser 23 to the reversing/ejecting roller pair 24).

Among the above, noise (A) has the nature of being generated uninterruptedly during print processing, whereas noises (B) to (F) are generated suddenly at specific locations. In the following, locations at which noises (B) to (F) are generated are defined as first specified locations. Note that the range of the first specified location (the length in the feeding direction) is conceptually a point, rather than a length, for noises (C), (D), and (E), but it is several to tens of millimeters [mm] for noises (B) and (F). For the latter case, instead of setting a predetermined longitudinal range, the most upstream end or the midpoint of such a range in the feeding direction may be set as the first specified location, as shown in Table 1 below.

Regarding Configuration of Sound Output Device

Figure 2:
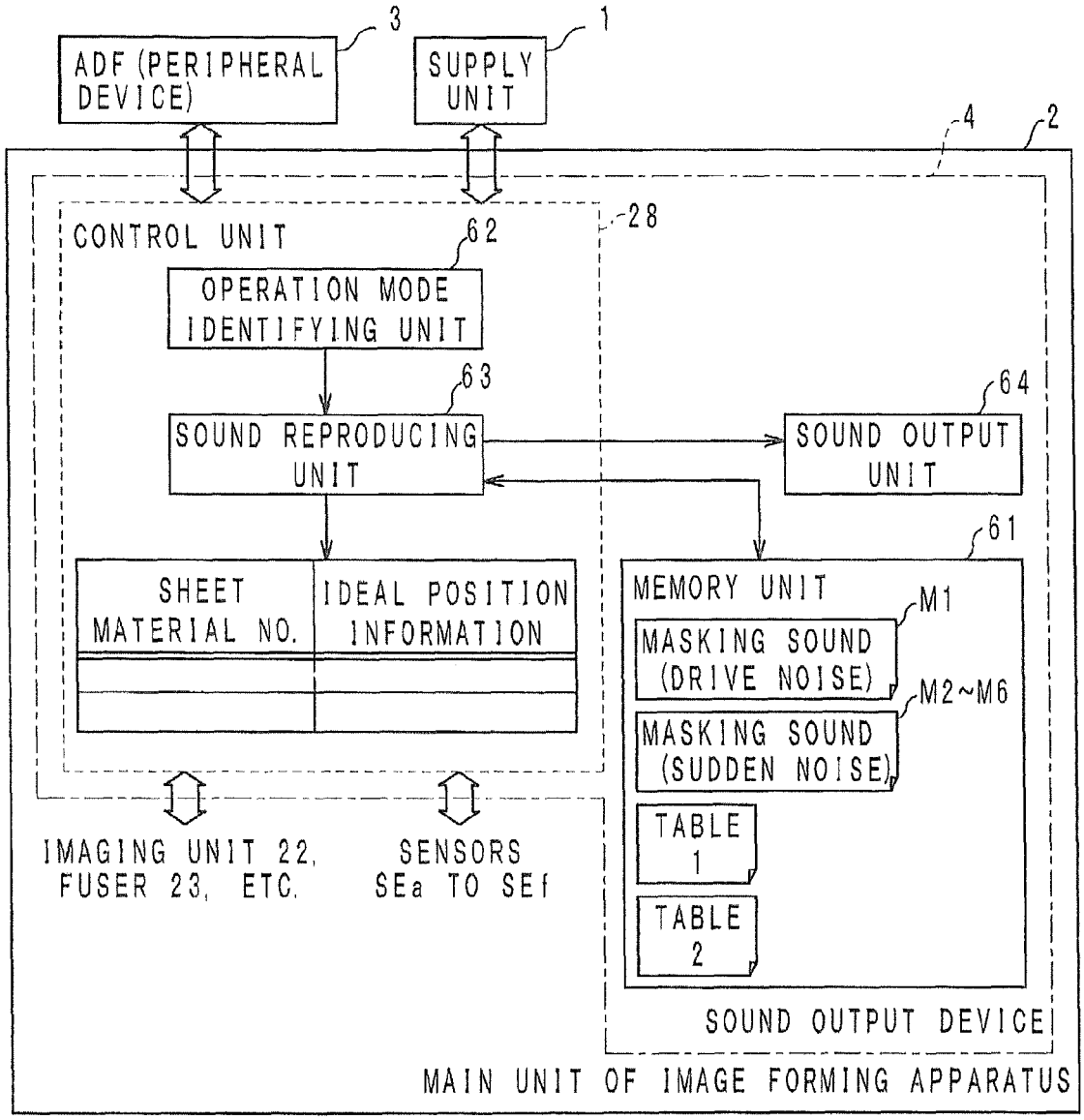
FIG. 2 is a block diagram illustrating the configuration of a sound output device included in the image forming apparatus of FIG. 1.

Furthermore, the main unit 2 of the image forming apparatus is provided with a sound output device 4 for masking the noise, as shown in FIG. 2. The sound output device 4 includes a memory unit 61, an operation mode identifying unit 62, a sound reproducing unit 63, and a sound output unit 64.

The memory unit 61 is composed of, for example, flash memory, and has stored therein sound data representing masking sounds M1 to M6 that mask their corresponding noises (A) to (F), respectively, for at least one operation mode (e.g., continuous print mode).

The masking sounds M1 to M6 are sounds obtained by, for example, processing the frequencies of environmental sounds so as to have frequency characteristics resembling those of the target noises. The masking sounds M1 to M6 are sounds incoherent to the user.

Figure 3:
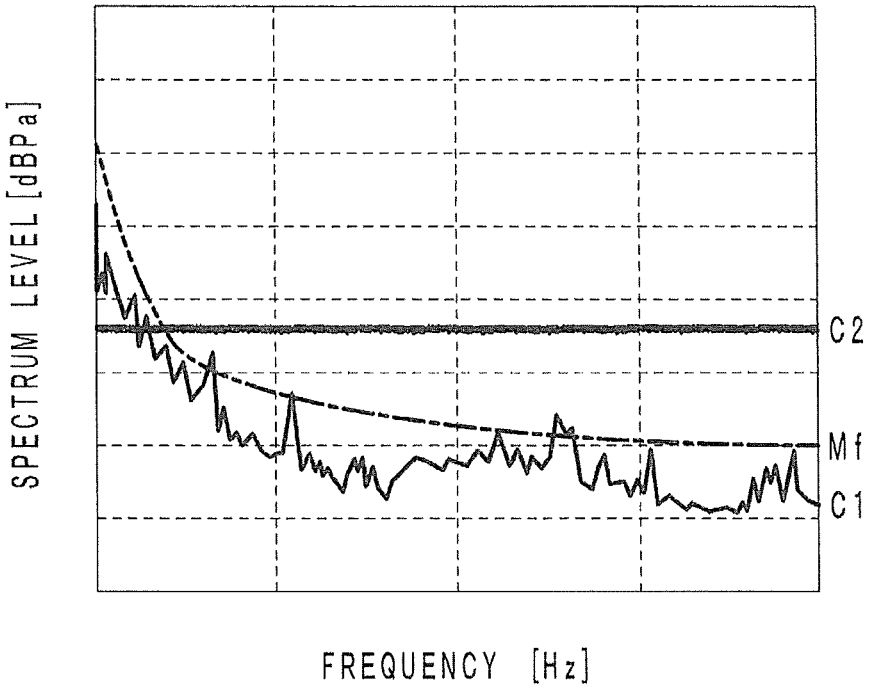
FIG. 3 is a graph showing the basic concept of masking.

The basic concept of masking will be described below with reference to FIGS. 3 to 5B. In FIG. 3, the horizontal axis represents frequency [Hz], and the vertical axis represents spectrum level [dBPa]. Curve C1 indicates a frequency characteristic of total noise generated by the image forming apparatus in a continuous print mode. The total noise whose frequency characteristic is indicated by curve C1 includes all of the noises (A) to (F) generated by the image forming apparatus. Further, curve C2 indicates a frequency characteristic of so-called white noise whose spectrum level is approximately constant regardless of the frequency. Furthermore, curve Mf indicates a frequency characteristic of a masking sound for the total noise.

When the total noise is superimposed with white noise, the sound leaves harshness in the ears of an observer, and in the case where the total noise is superimposed with a masking sound, such harshness can be significantly reduced. The masking effect can be increased by raising the pressure level of the masking sound. However, an increase in the pressure level of the sound generated by the image forming apparatus is another problem in itself. The present inventors found through experiments that, to deal with such an increase in the pressure level, it is effective to output a masking sound at a pressure level correlated with a change in the pressure level of the noise over time.

Figure 4:
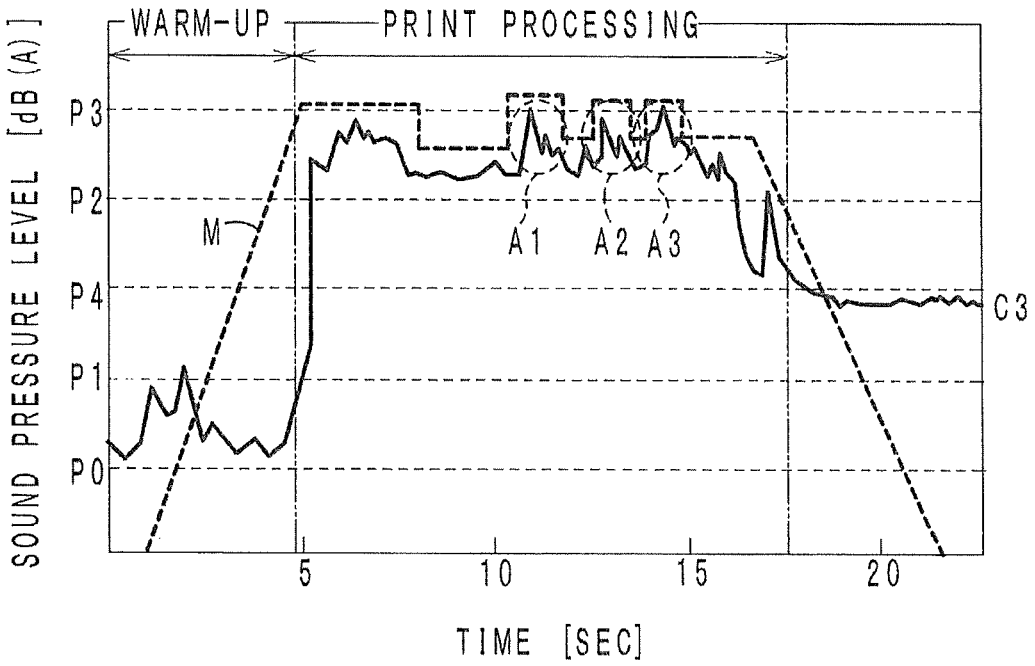
FIG. 4 is a temporal waveform chart of masking sound M which changes over time in correlation with noise.

FIG. 4 is a waveform chart showing temporal changes in, for example, sounds generated in the continuous print mode where the horizontal axis represents time and the vertical axis represents sound pressure level (dB(A)). The sound pressure level rises toward the upper end of the vertical axis. In FIG. 4, curve C3 indicates a change in the total noise over time for the continuous print mode. About the first five seconds of curve C3 correspond to warm-up. During warm-up, the sound pressure level of the noise is relatively low, and fluctuates approximately within the range of from P0 to P1 [dB(A)] (P0<P1).

In the example of FIG. 4, print processing is performed during a period approximately from the five-second mark to the eighteen-second mark. During print processing, a series of operations: supply→secondary transfer→fusing processing→ejection (or switchback), is performed on one sheet material P after another. As a result, the sound pressure level of the noise becomes relatively high, and fluctuates approximately within the range of pressure levels from P2 to P3 (P1<P2<P3). During this print processing period, noises (B) to (F) are generated suddenly (or intermittently in a pulsed manner). These sudden noises can be seen within three dotted ovals A1 to A3 on curve C3. The maximum sound pressure level of these sudden noises is approximately at P3, and the duration of the maximum level is within tens to a hundred ms.

After completion of the print processing (about after the eighteen-second mark), the sound pressure level of the noise becomes lower than in the print processing, and fluctuates around approximately P4 (P1<P4<P2).

The temporal characteristic of the noise represented by curve C3 is obtained in advance through experiments by the manufacturer of the image forming apparatus. On the basis of the obtained characteristic of the noise, the masking sound M shown in FIG. 4 is generated. The sound pressure level of the masking sound M changes in accordance with a change of the noise over time.

The generation time of the sudden noise varies among sheet materials P, as described above. To generate masking sounds for such noise, the masking sound M is subjected to frequency decomposition, so that masking sound M1 including frequency components of noise (A) is generated, and masking sounds M2 to M6 including frequency components of sudden noises (B) to (F) are generated as well. Acoustic data for these masking sounds M1 to M6 are obtained and stored into the memory unit 61, as shown in FIG. 2.

Figure 5A:
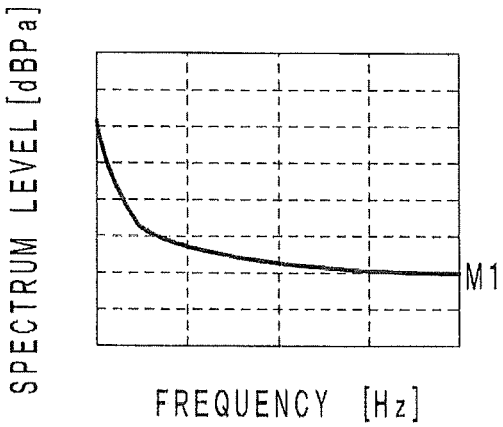
FIG. 5A is a waveform chart showing a frequency characteristic of masking sound M1.
Figure 5B:
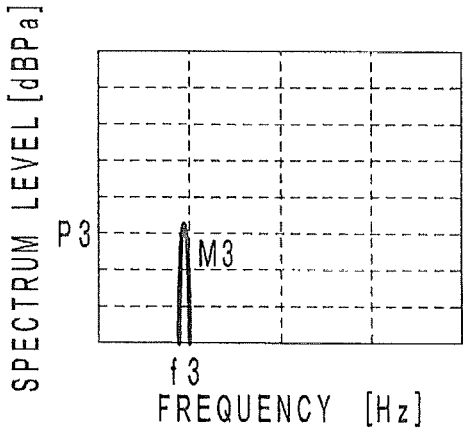
FIG. 5B is a waveform chart showing a frequency characteristic of masking sound M3.

Here, FIGS. 5A and 5B show frequency characteristics of masking sounds M1 and M3 as representative examples. In FIG. 5A, masking sound M1 is distributed across a relatively wide frequency range. On the other hand, masking sound M3 is distributed across a relatively narrow frequency band, including frequency f3 [Hz], and has a relatively high sound pressure level of approximately P3 [dBPa]. In FIG. 5B, masking sound M3 is merely shown as a representative, and other masking sounds M2, and M4 to M6 are also distributed across relatively narrow frequency bands, and have relatively high sound pressure levels as well.

Furthermore, for masking sounds M2 to M6, defaults for output timing, output duration, sound pressure level, and frequency are predetermined for each location of generation of target noise (i.e., for each first specified location), as shown in Table 1 below. Note that in Table 1, each nip is positioned at an intersection of the feeding path and a line extending between a pair of roller axes, and the output timing is measured with respect to the leading edge of the sheet material.

TABLE 1

Defaults for output timing/output duration of masking sounds

| Location of noise generation (first specified location) | Output timing | Output duration | Sound pressure level [dBPa] | Frequency [Hz] |
|---|---|---|---|---|
| (B) Supply roller 13 to sensor SEb | Supply position to 20 mm downstream | Time to forward the length of sheet material + 100 ms | P5 | f5 |
| (C) Resist nip | Resist nip | 100 ms | P3 | f2 |
| (D) Secondary transfer nip | Secondary transfer nip | 100 ms | P6 | f6 |
| (E) Fusing nip | Fusing nip | 80 ms | P7 | f7 |
| (F) Fusing nip to ejection/reversing roller 24 | Fusing nip to 320 mm downstream | Time to forward the length of sheet material + 20 ms | P8 | f4 |

The defaults are suitably set by the manufacturer in accordance with, for example, internal components of the image forming apparatus and their materials. For example, as for noise (C), the output timing for the masking sound is set at the position of the resist nip, the output duration is set at 100 ms, the sound pressure level is set at P3 dBPa, and the frequency is set at f2 Hz.

The memory unit 61 has stored therein a table describing information as shown in Table 1 (hereinafter, the table is simply referred to as Table 1 for convenience's sake).

Furthermore, as for noises (B) to (F), the output timing, i.e., the time at which the sheet material P reaches the first specified location, is not constant. Accordingly, it might not be appropriate to output masking sounds M2 to M6 in accordance with their defaults. Therefore, in addition to Table 1, the memory unit 61 has stored therein a table describing information as shown in Table 2 below (hereinafter, the table is simply referred to as Table 2 for convenience's sake).

TABLE 2

Adjustment values for output timing, output duration, etc., of masking sound M3

| Deviation in time of arrival | Output timing | Output duration [ms] | Sound pressure level [dBPa] | Frequency [Hz] |
|---|---|---|---|---|
| Ahead by 2 mm or more | Ahead by amount of deviation | 100 | P3 + ΔP | f2 + Δf |
| Ahead by 1 mm or more but less than 2 mm | Ahead by 1 mm | 100 | P3 + ΔP | f2 |
| Standard (less than \|1\| mm) | Default | Default | Default | Default |
| Behind by 1 mm or more but less than 2 mm | Behind by 1 mm | 100 | P3 | f2 |
| Behind by 2 mm or more | Behind by amount of deviation | 100 | P3 − ΔP | f2 |

For each amount of deviation in the actual time of arrival of the sheet material P at the first specified location (the position of the resist nip), Table 2 lists adjustment values for the output timing, the output duration, the sound pressure level, and the frequency of masking sound M3 for noise (C). The definition of the amount of deviation in the time of arrival herein will be described later. The adjustment values are, for example, values appropriately determined by the manufacturer, as with the defaults. For example, in the case where the sheet material P reaches the resist nip ahead by 2 mm or more, the output timing is put ahead by the amount of deviation, the output duration is set at 100 ms, the sound pressure level is set at P3+ΔP dBPa, and the frequency is set at f2+Δf. Note that Table 2 indicates the output timing in length by way of example, but in actual control, an adjustment is made in terms of time relative to the speed of feeding the sheet material.

Note that Table 2 lists adjustment values for other times of arrival as well. In addition, tables similar to Table 2 are stored for masking sounds M2, and M4 to M6 as well.

Referring again to FIG. 2, the operation mode identifying unit 62 and the sound reproducing unit 63 are realized, for example, as software incorporated in the control unit 28. In addition, the sound output unit 64 is specifically a speaker disposed, for example, at the front of the image forming apparatus.

Operation of Sound Output Device

Next, the operation of the sound output device 4 thus configured will be described with reference to. FIGS. 6 to 10.

First, on the basis of a print start command or suchlike transmitted from an input device (not shown) included in the image forming apparatus, the operation mode identifying unit 62 identifies the current operation mode (e.g., continuous print mode). Thereafter, the control unit 28 decides the feed speed, and other parameters, and starts operating the drive mechanisms (such as motors) for the rotors, etc. Simultaneously, the sound output device 4 starts outputting masking sound M1. After completion of warm-up, print processing starts, so that the sheet material P starts to be forwarded from the supply unit 1 to the feeding path R1.

Furthermore, to manage positions of the sheet material P in the feeding path R1 and in the reverse path R2, the control unit 28 uses an unillustrated timer to measure elapsed time in milliseconds from the point of forwarding from the supply unit 1 to the feeding path R1 or from the start of movement of the resist roller pair 21. The elapsed time is used as information by which the current position of the sheet material P in the feeding path R1 or in the reverse path R2 can be derived on the assumption that there is no feeding variability or the like (hereinafter, such a position will be referred to as an ideal position). The control unit 28 holds information about the ideal position for each sheet material P that is being fed, in, for example, the main memory, as shown in FIG. 2.

Figure 6:
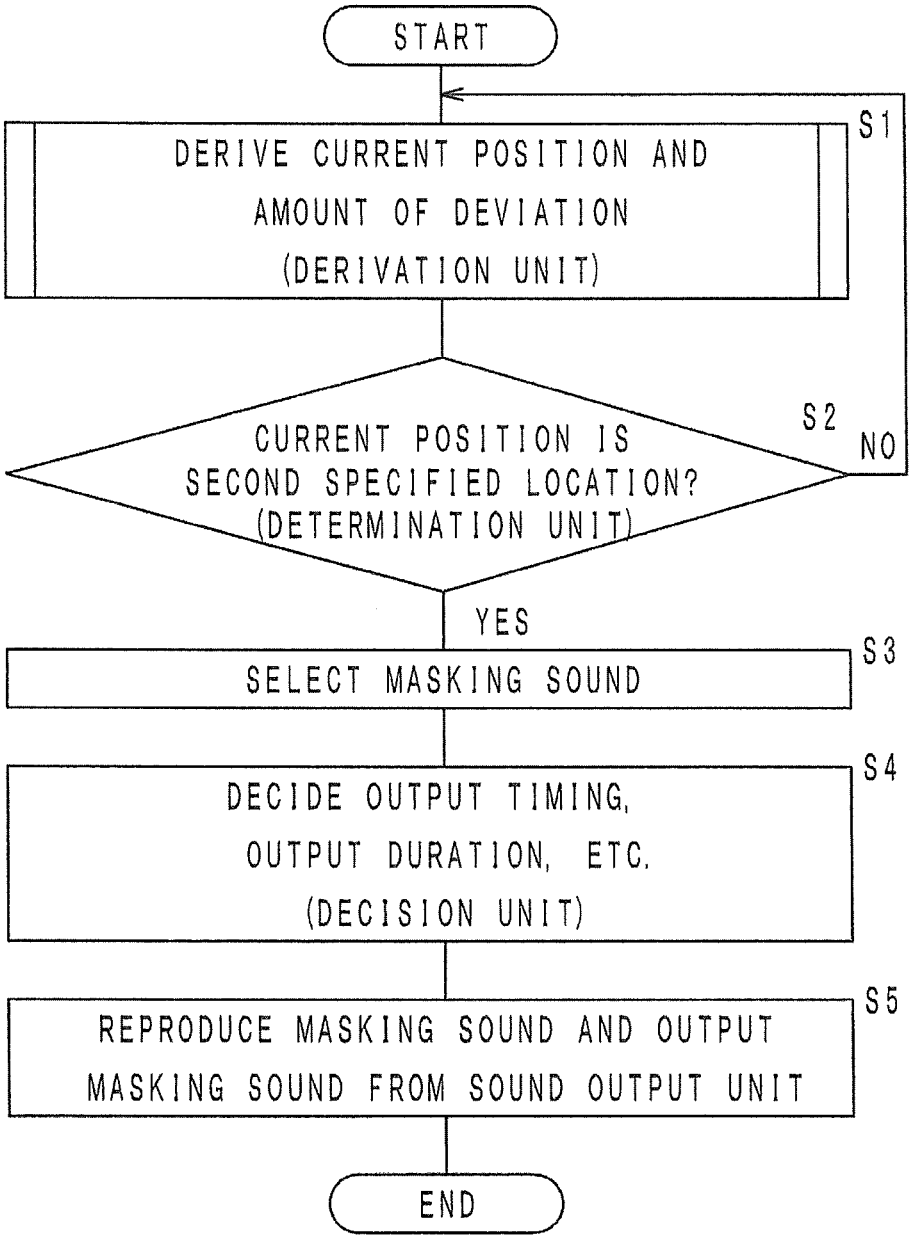
FIG. 6 is a main flowchart illustrating the process steps by a sound reproducing unit.

Furthermore, when print processing starts, the sound reproducing unit 63 of the control unit 28 starts the process shown in FIG. 6. In S1 of FIG. 6, the sound reproducing unit 63 functions as a derivation unit to derive the current position and the amount of deviation of the sheet material P. Here, the amount of deviation refers to a difference between the ideal position and the actual current position, and is substantially equal to the amount of deviation in the time of arrival listed in Table 2. The actual current position refers to the actual position in the feeding path R1 or in the reverse path R2 where the sheet material P currently is as a result of being affected by feeding variability or the like. More specifically, it is the time of arrival of the sheet material P at a third specified location where any one of the sensors SEa to SEe is provided.

Next, in S2, the sound reproducing unit 63 functions as a determination unit to determine, on the basis of the current position obtained in S1, whether the sheet material P that is being fed has reached the second specified location at a predetermined distance upstream from the first specified location. Here, the time of arrival of the sheet material P at the first specified location can be earlier or later than the default output timing. The predetermined distance is appropriately set considering variability, particularly on the assumption that the sheet material P arrives early. For example, for masking sound M3, the predetermined distance is set at about 5 mm, as shown in FIG. 1.

When the determination of S2 is negative, the process returns to S1. On the other hand, when the determination is affirmative, in S3, the sound reproducing unit 63 selects a masking sound to be currently outputted from among masking sounds M2 to M6 in accordance with the first specified location. For example, when the sheet material P is positioned 5 mm before the resist nip, the sound reproducing unit 63 selects masking sound M3 corresponding to the position of noise generation.

Next, in S4, the sound reproducing unit 63 functions as a decision unit to decide the output timing, the output duration, the sound pressure level, and the frequency of the masking sound selected in S3 in accordance with the amount of deviation derived in S1. Specifically, the output timing and other parameters are decided in accordance with Tables 1 and 2 stored in the memory unit 61. For example, when the amount of deviation in the time of arrival is ahead by more than 2 mm, the adjustment values listed in the top panel of Table 2 are used. In this case, the output timing is put forward by the amount of deviation, the output duration is set at 100 ms, the sound pressure level is set at P3+ΔP, and the frequency is set at f2+Δf.

Next, in S5, the sound reproducing unit 63 reproduces and outputs the masking sound selected in S3 from the sound output unit 64 in accordance with the output timing and so on decided in S4.

Next, referring to FIG. 7, the processing of S1 will be described in detail. The sound reproducing unit 63 functions as both first and second derivation units to derive the actual current position and the ideal position of the sheet material P, respectively, in S71 and S72.

Figure 7:
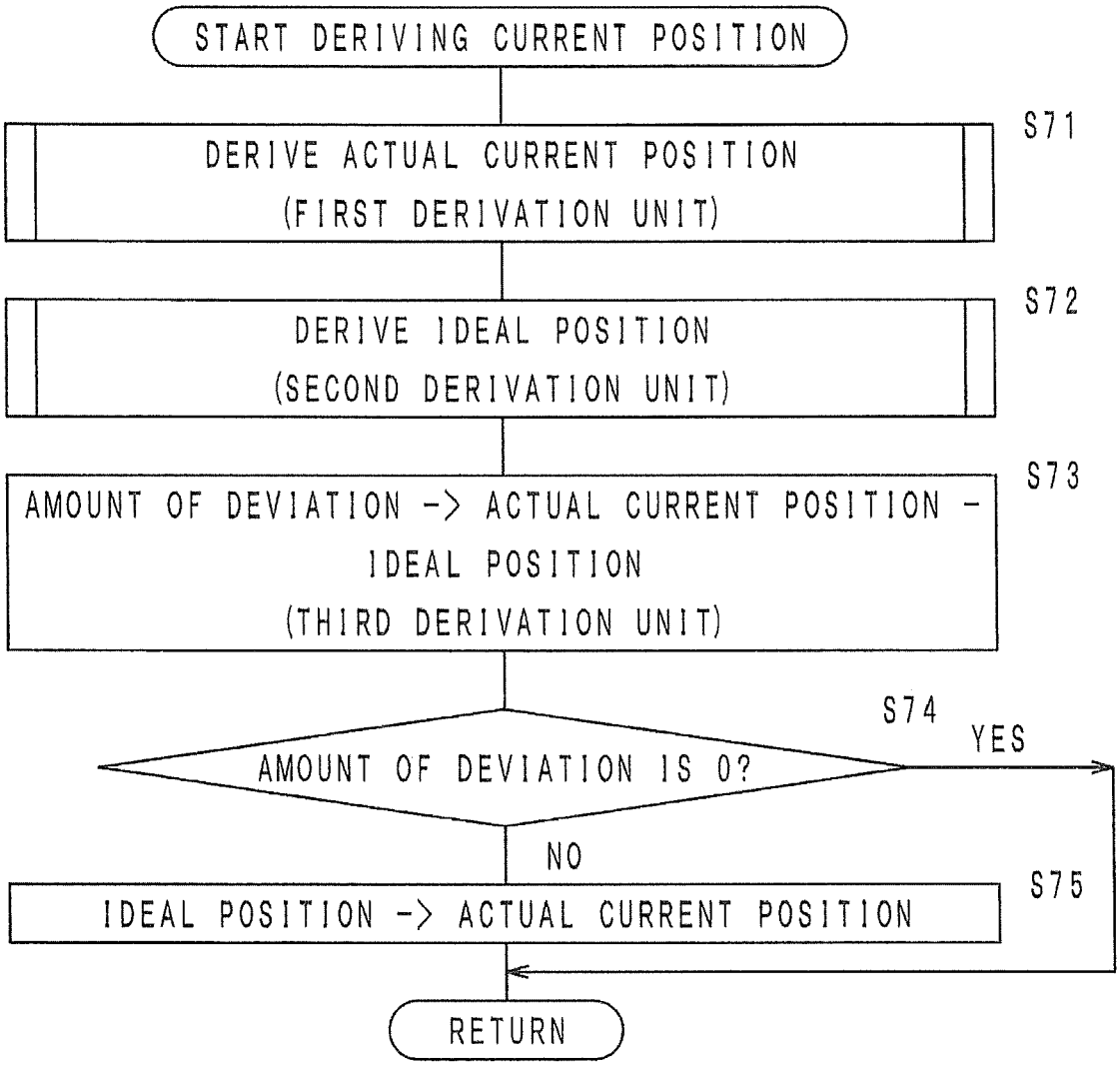
FIG. 7 is a flowchart illustrating in detail the processing of S1 in FIG. 6.
Figure 8:
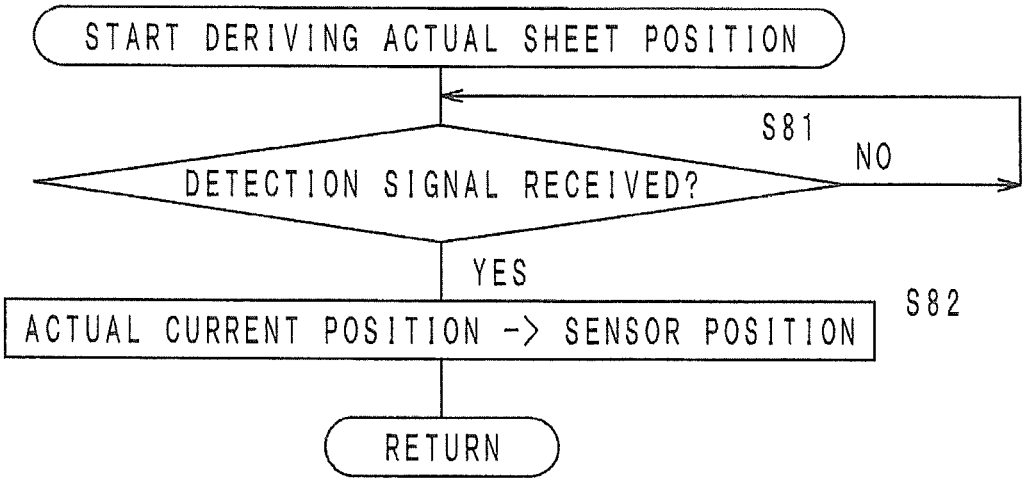
FIG. 8 is a flowchart illustrating in detail the processing of S71 in FIG. 7.

Referring to FIG. 8, the processing of S71 will now be described in detail. Once a detection signal is received from any one of the sensors SEa to SEe in S81, the sound reproducing unit 63 recognizes the position of the sensor as the corresponding current position of the sheet material P in S82. For example, when the sheet material P passes through the installation position of the resist sensor SEb (at 40 mm from the position of the supply roller 13), the sound reproducing unit 63 sets the current position at 40 mm. Upon completion of S82, the sound reproducing unit 63 exits the process of FIG. 8, and performs S72 of FIG. 7.

Next, referring to FIG. 9, the processing of S72 will be described in detail. For each sheet material P, the sound reproducing unit 63 acquires elapsed time (ideal position information) and current feed speed, respectively, in S91 and S92. Thereafter, in S93, the sound reproducing unit 63 updates the ideal position of the sheet material P to the product of the acquired elapsed time (ideal position information) and the acquired feed speed. For example, when the current elapsed time is 380 ms (0.38 seconds), and the feed speed is 100 mm/sec, the ideal position is updated to 38 mm from the supply roller 13. Upon completion of S93, the sound reproducing unit 63 exits the process of FIG. 9, and performs S73 of FIG. 7.

In S73 of FIG. 7, the sound reproducing unit 63 functions as a third derivation unit to derive the difference between the actual current position obtained in S71 and the ideal position obtained in S72, as an amount of deviation. In the above example, since the ideal position is 38 mm, and the current position is 40 mm, the amount of deviation is ahead by 2 mm.

Next, in S74, the sound reproducing unit 63 determines whether the amount of deviation obtained in S73 is 0 or not, and when it is 0, the sound reproducing unit 63 exits the process of FIG. 7 without updating the ideal position, and performs S2 of FIG. 6. On the other hand, when it is not 0, the sound reproducing unit 63 updates the ideal position to the actual current position in S75, and thereafter the sound reproducing unit 63 exits the process of FIG. 7, and performs S2 of FIG. 6.

Figure 10A:
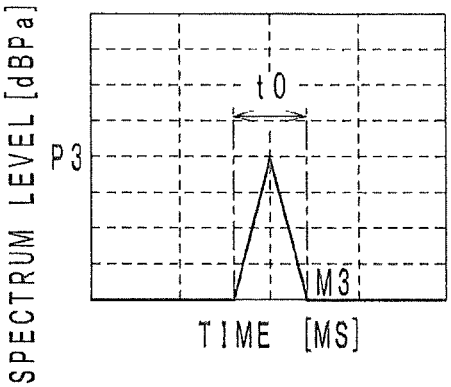
FIG. 10A is a graph illustrating a masking sound with default output duration.

As a result of the above processing, for example, in the case where masking sound M3 is outputted in accordance with defaults, when the sheet material P passes through the position of the resist nip, masking sound M3 is outputted at a sound pressure level of P3 and a frequency of f2 for 100 ms, in accordance with Table 1, as shown in FIG. 10A.

Figure 10B:
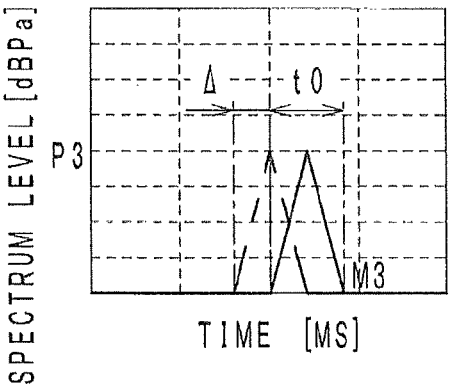
FIG. 10B is a graph illustrating the masking sound with its output timing put forward by an amount of deviation.

On the other hand, in the case where the time of arrival of the sheet material P is ahead by 2 mm or more, masking sound M3 is outputted in accordance with the adjustment values listed in the top panel of Table 2, as shown in FIG. 10B. Specifically, when compared to the case where the sheet material. P is at the default position, masking sound M3 is outputted earlier by an amount of deviation A.

Figure 10C:
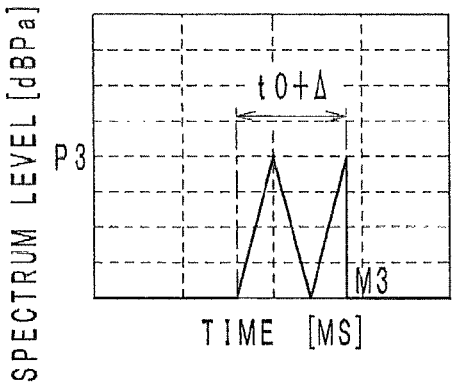
FIG. 10C is a graph illustrating the masking sound with its output duration increased by an amount of deviation.

Furthermore, if the adjustment value for output duration listed in Table 2 is 100 ms+an amount of deviation, masking sound M3 is outputted for that time of period, as shown in FIG. 10C. Likewise, when Table 2 lists adjustment values for sound pressure level and frequency, masking sound M3 is outputted in accordance with the adjustment values. Moreover, where necessary, masking sound M3 can be outputted in a manner combining FIGS. 10B and 10C, i.e., the output timing is ahead by the amount of deviation A, and the output duration is 100 ms+the amount of deviation.

Actions and Effects of Embodiment

As described above, in the present embodiment, the sound reproducing unit 63 initially derives the current position of the sheet material P being fed in the feeding path R1, and then determines whether or not the sheet material P has reached the second specified location on the basis of the derived current position. If the determination is affirmative, the sound reproducing unit 63 selects a target masking sound in the memory unit 61, and at least decides the output timing and/or the output duration for that sound. The sound reproducing unit 63 starts reproducing the target masking sound, and outputs the sound from the sound output unit 64 in accordance with the decided output timing and/or output duration.

As a result of the above processing, the masking sound is outputted in accordance with appropriate output timing and/or output duration for dealing with noise generated in the first specified location in the feeding path R1. In this manner, the present embodiment makes it possible to provide an image forming apparatus capable of effectively masking noise caused by a sheet material being fed.

Supplementary 1

Incidentally, in the embodiment, sudden noises (B) to (F) are described as examples, along with their respective masking sounds M2 to M6. However, output control for sudden noise generated at other locations (e.g., a curved portion of the reverse path R2) may be performed in manners as shown in FIGS. 6 to 10. Moreover, the fuser 23 heats the heating roller by driving a coil of the power circuit. At this time, the coil generates vibrating noise. Output control of a masking sound for such vibrating noise may be performed.

Furthermore, in the example of the embodiment shown in FIG. 1, an automatic document feeder (ADF) 3 is provided directly above the main unit 2 as a peripheral device. The ADF 3 has a tray 41 on which document D, which is another example of the sheet material, can be placed. A supply unit 42 is configured in the same manner as the supply unit 1, so that sheet materials P are picked up from the tray 41, and separated one by one to be forwarded to a feeding path R3 (see a long dashed short dashed line).

A resist roller pair 43 is configured in the same manner as the resist roller pair 21, so as to rotate under timing control of the control unit 28, whereby the document D from the supply unit 42 is forwarded further downstream (i.e., toward reading position A) of the feeding path R3. Provided immediately upstream from the resist roller pair 43 is a resist sensor SEf playing a similar role to the resist sensor SEb. An ejection roller pair 44 ejects the document D having passed through reading position A to an output tray 45.

A document reading unit 46 is fixed immediately below reading position A, and sequentially reads lines of the document D passing through reading position A, one by one. Specifically, the document reading unit 46 has a light-emitting device that illuminates reading position A. Light reflected by the document D falls on an imaging lens via a plurality of mirrors, ultimately forming an image on an image pickup device. The image pickup device performs photoelectric conversion on the light to sequentially generate image data that represents one line of the document D, and then output the data to the control unit 28.

The resist roller pair 43 also generates sudden noise, and output control can be applied to this noise as well in manners as shown in FIGS. 6 to 9. In addition, when a finisher is provided as another peripheral device to the image forming apparatus, a feeding path in the finisher may be considered for noise masking.

Supplementary 2

Furthermore, Table 2 lists adjustment values for each time of arrival in the continuous print mode. However, masking sound output control may be similarly performed in another mode (e.g., a single-sheet print mode or a monochrome mode). In addition, adjustment values for each time of arrival and each feed speed may further be listed in Table 2 in order to perform masking sound output control in accordance with the time of arrival and the feed speed. Moreover, the flexibility (sturdiness) of the sheet material P changes in accordance with the internal/ambient temperature and humidity of the image forming apparatus or depending on the size or type of the sheet material P, and therefore masking sound output control may be performed in accordance with such parameters.

Supplementary 3

Furthermore, the ideal position has been described above as the product of the elapsed time and the feed speed. However, this is not restrictive, and in S72, the elapsed time after forwarding to the feeding path R1 may be used in place of the ideal position. In such a case, the actual current position in S71 is represented by a value obtained by dividing the sensor position (i.e., the distance from the supply roller 13) by the feed speed.

Modification

Figure 9:
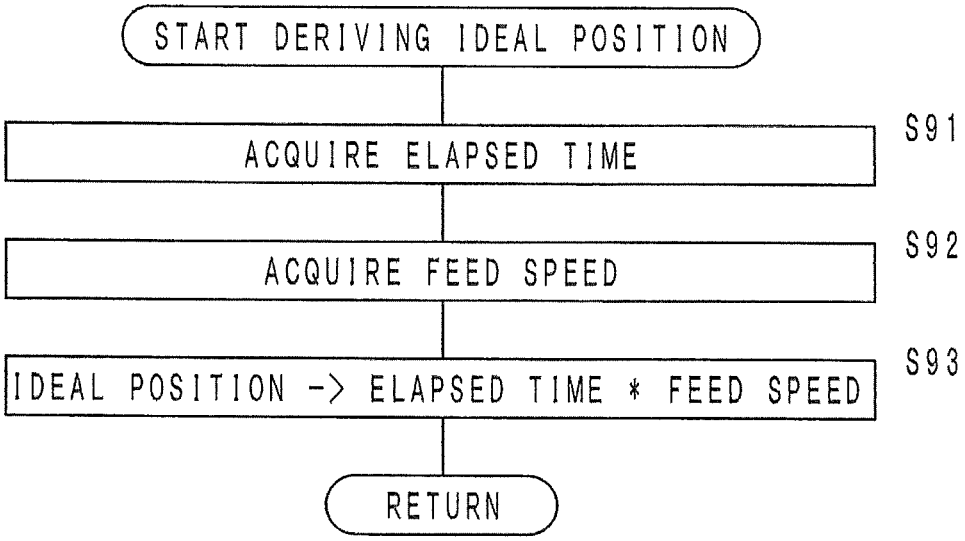
FIG. 9 is a flowchart illustrating in detail the processing of S72 in FIG. 7.
Figure 11:
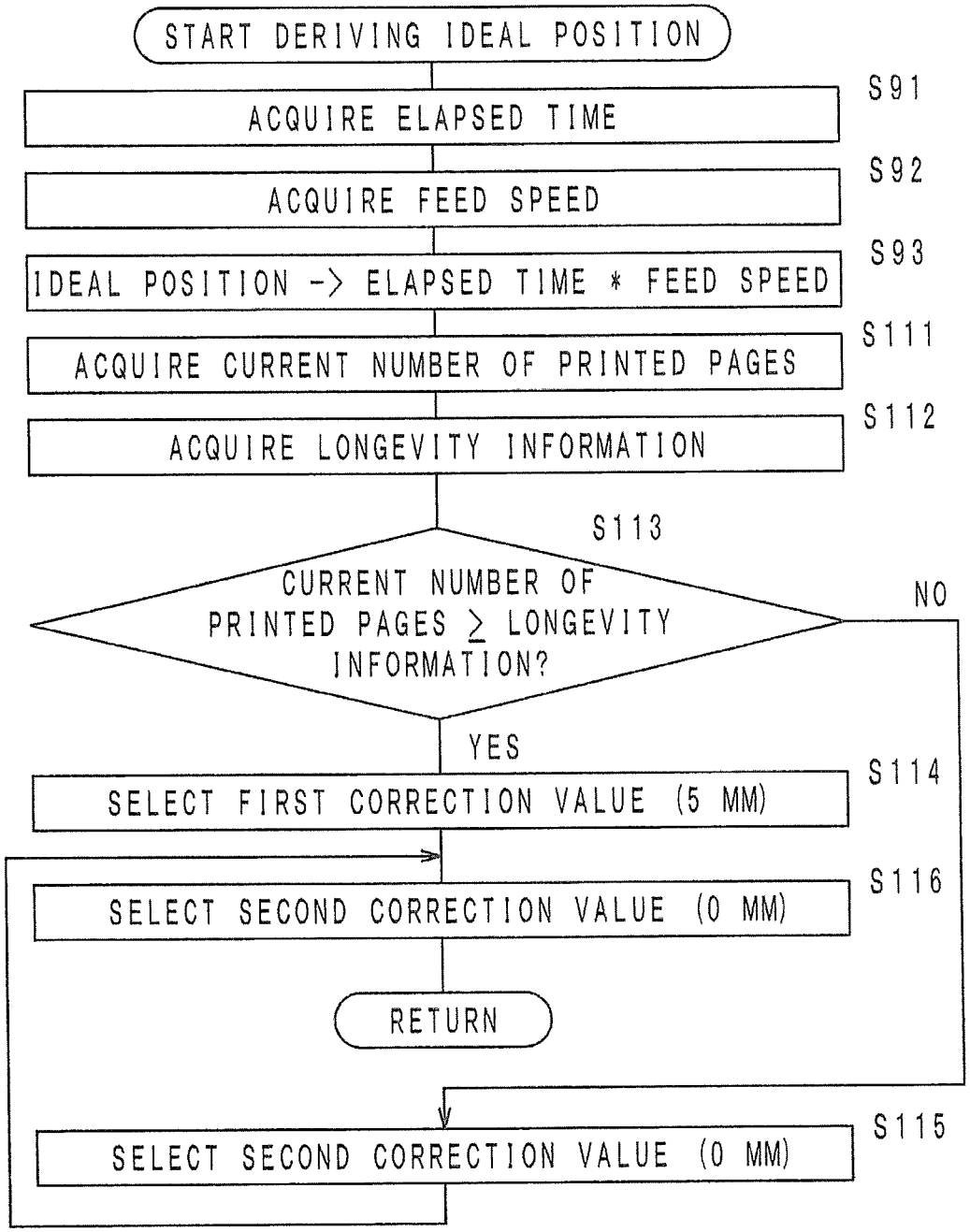
FIG. 11 is a flowchart illustrating in detail the processing of S72 in FIG. 7 in accordance with a modification.

Next, an image forming apparatus according to a modification will be described. This modification differs from the embodiment in the following three points:

(1) The control unit 28 counts the number of printed pages;

(2) The memory unit 61 has stored therein longevity information for at least, one rotor; and (3) The sound reproducing unit 63 performs the process of FIG. 11, rather than the process of FIG. 9.

Since there is no difference other than the above three points, components and processing steps in the present modification that correspond to those in the embodiment are denoted by the same reference characters and numbers, and any descriptions thereof will be omitted.

The longevity information is information indicating the service life of a target rotor, and a specific example thereof is a total number of printed pages for which the rotor can achieve a designed feed speed. The total number of printed pages is predetermined as, for example, 10,000.

In FIG. 11, the sound reproducing unit 63 functions as a fourth derivation unit after execution of S91 to S93 (see FIG. 9). Specifically, the sound reproducing unit 63 acquires the current number of printed pages and longevity information, respectively, in S111 and S112, and determines in S113 whether the current number of printed pages is or is not equal to or greater than the value of the longevity information.

When the determination is affirmative, the sound reproducing unit 63 judges the designed feed speed to be not achievable, for example, due to slipping of the rotor. In such a case, the sound reproducing unit 63 functions as an example of the fourth derivation unit in S114, to derive a first correction value, which is relatively high (e.g., −5 mm (behind by 5 mm)). On the other hand, when the determination is negative, the sound reproducing unit 63 functions as another example of the fourth derivation unit in S115, to select a second correction value, which is relatively low (e.g., 0 mm).

In S116, following S114 or S115, the sound reproducing unit 63 adds the correction value selected by the current process of FIG. 11 to the ideal position obtained in S93. After completion of S116, the sound reproducing unit 63 exits the process of FIG. 11, and performs S73 of FIG. 7.

Actions and Effects of Modification

Even if the feed speed of the rotor is invariable, the amount of feed of the sheet material P varies between the case where the service life of the rotor has already been expired and the case where it has not yet been expired. In the above embodiment, it might not be possible to adjust the amount of deviation in the time of arrival caused by such a change in the amount of feed. Specifically, in the embodiment, the actual current position is updated to the position of a sensor. However, with this processing alone, the deviation in the time of arrival caused by a change in the amount of feed cannot be reflected in the (adjusted) timing of outputting the masking sound, so that the masking sound is not outputted at the exact time of actual noise generation. Therefore, in the present modification, for example, the timing of outputting the masking sound is adjusted further considering a change in the amount of feed of the sheet material P, thereby making it possible to provide an image forming apparatus capable of more effectively masking sudden noise.

Supplementary 4

Note that the modification has been described with respect to the case where the correction value is derived on the basis of the longevity information, and added to the value of the ideal position in S116. However, in addition to the longevity information, the process of FIG. 11 may be performed on the basis of at least one of the following: feeding mode, size and type of sheet material to be fed by the rotor, and temperature and humidity inside and outside the image forming apparatus, because such parameters affect the feed speed of the rotor and cause a deviation in the position of the sheet material P. Here, the feeding mode is determined mainly by the positions of the supply tray and the output tray for the sheet material P.

Supplementary 5

Furthermore, Supplementaries 1 through 3 to the embodiment apply to the present modification as well.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus, comprising:

a supply unit that forwards a sheet material on a tray to a feeding path;

a rotor that feeds the sheet material in the feeding path;

a detection unit that detects the sheet material being fed and outputs a detection signal;

a memory unit that has stored therein a masking sound for noise generated at a first specified location in the feeding path during the feeding of the sheet material, wherein the masking sound possesses a default intensity and a default frequency;

a derivation unit that derives:

a current position of the sheet material being fed in the feeding path on the basis of the detection signal outputted by the detection unit, an ideal position in the feeding path at which the sheet material should be located, on the basis of an elapsed time from the forwarding of the sheet material by the supply unit or from the start of rotation of a resist roller pair provided in the feeding path and operable to rotate and stop rotating, and also on the basis of a speed of the rotor feeding the sheet material, and an amount of position deviation between the derived current position and the derived ideal position;

a determination unit that determines, on the basis of the current position derived by the derivation unit, an affirmative determination when the sheet material being fed has reached a second specified location at a predetermined distance upstream from the first specified location;

a decision unit that decides at least one of output timing and output duration for the masking sound in the memory unit on the basis of the amount of position deviation derived by the derivation unit and further decides at least one of an intensity and a frequency of the masking sound in the memory unit on the basis of the amount of position deviation upon the affirmative determination by the determination unit; and a sound output unit that outputs the masking sound in the memory unit in accordance with at least one of the output timing and the output duration and at least one of the intensity and the frequency decided by the decision unit, wherein the at least one of the intensity and the frequency of the masking sound, decided by the decision unit on the basis of the amount of position deviation, is different than at least one of the default intensity and the default frequency when the amount of position deviation is above a predetermined value.

2. The image forming apparatus according to claim 1, wherein the derivation unit further derives a correction value for the derived ideal position on the basis of at least one of the following: longevity information about the rotor and feeding mode; size and type of sheet material to be fed by the rotor; and temperature and humidity inside and outside the image forming apparatus;

the image forming apparatus further comprises a correction unit for correcting the ideal position derived by the derivation unit, on the basis of the correction value derived by the derivation unit; and the derivation unit derives the amount of position deviation between the ideal position corrected by the correction unit and the derived current position.

3. The image forming apparatus according to claim 1, wherein the decision unit decides the output timing of the masking sound in the memory unit by shifting a default for the output timing of the masking sound by the amount of deviation derived by the derivation unit.

4. The image forming apparatus according to claim 1, wherein the decision unit decides the output duration of the masking sound in the memory unit by increasing a default for the output duration of the masking sound by the amount of position deviation derived by the derivation unit.

5. The image forming apparatus according to claim 1, wherein the derivation unit derives:

the current position of the sheet material being fed in the feeding path on the basis of the detection signal outputted by the detection unit at a specific time, the ideal position in the feeding path at which the sheet material should be located at the specific time, and the amount of position deviation between the derived current position at the specific time and the derived ideal position at the specific time.

6. The image forming apparatus according to claim 1, wherein the intensity of the masking sound is greater when the derived current position is ahead of the derived ideal position than when the derived current position is equal to or behind the derived ideal position.

7. An image forming apparatus, comprising:

a supply unit that forwards a sheet material on a tray to a feeding path;

a rotor that feeds the sheet material in the feeding path;

a detection unit that detects the sheet material being fed and outputs a detection signal;

a memory unit that has stored therein a masking sound for noise generated at a first specified location in the feeding path during the feeding of the sheet material, wherein the masking sound possesses a default intensity and a default frequency;

a derivation unit that derives:

a current position of the sheet material being fed in the feeding path on the basis of the detection signal outputted by the detection unit, an ideal position in the feeding path at which the sheet material should be located, on the basis of an elapsed time from the forwarding of the sheet material by the supply unit or from the start of rotation of a resist roller pair provided in the feeding path and operable to rotate and stop rotating, and also on the basis of a speed of the rotor feeding the sheet material, and an amount of time deviation of the elapsed time;

a determination unit that determines, on the basis of the current position derived by the derivation unit, an affirmative determination when the sheet material being fed has reached a second specified location at a predetermined distance upstream from the first specified location;

a decision unit that decides at least one of output timing and output duration for the masking sound in the memory unit on the basis of the amount of time deviation derived by the derivation unit and further decides at least one of an intensity and a frequency of the masking sound in the memory unit on the basis of the amount of time deviation upon the affirmative determination by the determination unit; and a sound output unit that outputs the masking sound in the memory unit in accordance with at least one of the output timing and the output duration and at least one of the intensity and the frequency decided by the decision unit, wherein the at least one of the intensity and the frequency of the masking sound, decided by the decision unit on the basis of the amount of time deviation, is different than at least one of the default intensity and the default frequency when the amount of time deviation is above a predetermined value.

8. The image forming apparatus according to claim 7, wherein the intensity of the masking sound is greater when the derived current position is ahead of the derived ideal position than when the derived current position is equal to or behind the derived ideal position.

* * * * *